United States Patent [19]

Shypula

[11] 4,245,414

[45] Jan. 20, 1981

[54] DISPLAY RACK AND CARD THEREFOR

[75] Inventor: Michael W. Shypula, Bridgeport, Conn.

[73] Assignee: National Distillers and Chemical Corp., New York, N.Y.

[21] Appl. No.: 925,124

[22] Filed: Jul. 17, 1978

[51] Int. Cl.[3] ..... G09F 1/10

[52] U.S. Cl. ..... 40/124; 40/124.1; 40/19.5

[58] Field of Search ..... 40/19.5, 124, 124.1, 40/622; 35/7 R

[56] References Cited

U.S. PATENT DOCUMENTS

| | | | |
|---|---|---|---|
| 1,726,537 | 9/1929 | Carmichael | 40/124 |
| 2,132,652 | 10/1938 | Schmiedemann | 40/124 X |
| 3,484,967 | 12/1969 | Webb | 40/19.5 |
| 3,799,357 | 3/1974 | Govang | 35/7 R |
| 3,824,722 | 7/1974 | Maruscak et al. | 40/622 |

*Primary Examiner*—Gene Mancene
*Assistant Examiner*—Wenceslao J. Contreras
*Attorney, Agent, or Firm*—Kenneth D. Tremain

[57] ABSTRACT

A method and system for displaying hardware items so as to facilitate the disposition of the items or products in appropriate places on panels in a time period much shorter than is conventionally encountered.

6 Claims, 7 Drawing Figures

FIG. 5
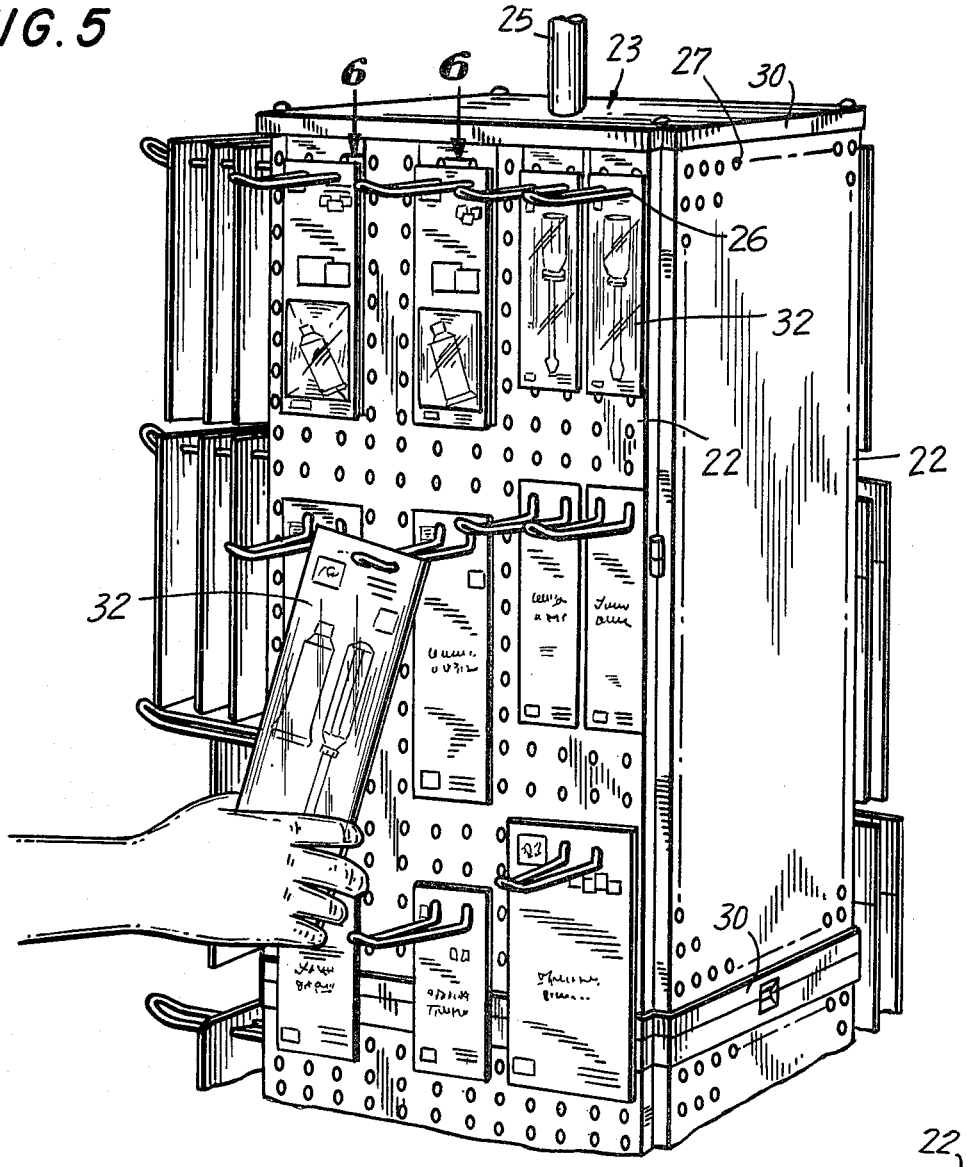
FIG. 6
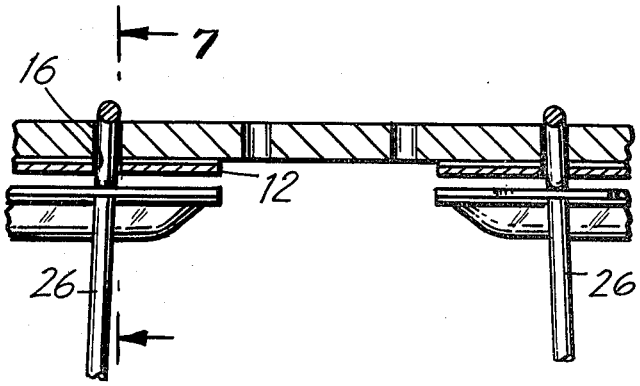
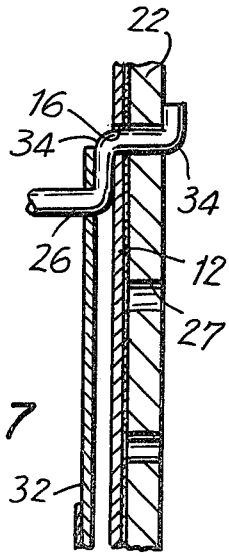
FIG. 7

DISPLAY RACK AND CARD THEREFOR

BACKGROUND OF THE INVENTION

The present invention relates to a method and system of displaying hardware products, and particularly to such a system involving display board panels and the like in a wall mounted environment or on a display rack.

It has become a common practice in the merchandising of hardware items or products to utilize display racks as part of point of sale merchandising techniques. Such racks often take the form of two-dimensional wall units or so-called floor merchandisers, the latter comprising a three-dimensional arrangement, such as, for example, a three or four sided rotatable rack. What this merchandising practice generally involves is the deplopment of the hardware items on peg board panels by inserting hooks of one kind or another through apertures which are generally arrayed, in an orderly way on the display board, such that the hardware items can be easily mounted or hung on the hooks. In order to guide the placement of the items in setting up the display, and to serve eventually as a means of furnishing information to the prospective customer, "out-of-stock" cards are generally suitably spaced from each other and in near abutting relationship to the display board panels. These "out-of-stock" cards are carried by the hooks, the hooks being inserted through apertures provided in the cards.

Although conventional systems for displaying hardware products in the aforedescribed way have gained acceptance and are widely used, a very severe drawback to the merchandising of hardware in this manner is that the jobber or retailer finds that he does not wat to spend the significant amount of time normally consumed in setting up the display system. For example, it quite often takes two and one-half hours to set up a complete hardware display system involving a four-sided display rack. This time consumption is partly accounted for by the fact that there is a tendency not to place the appropriate hooks into the display board panel at sufficiently close spacing with respect to adjacent hooks so that oftentimes space is lost on the panel. Consequently, the jobber or retailer has to go back and re-do a particular panel and the whole process can be very frustrating. In order to assist the jobber or retailer a schematic or general layout of the display system is sometimes furnished; that is to say, a layout which shows how the particular out-of-stock cards, as well as trays and booklet containers are to be set up on the panel. A fundamental difficulty with the use of the schematic, however, is that quite often the card numbers include digits that are very similar, such that these digits are sometimes mentally reversed, and the result is that the cards are not placed in their proper locations.

Accordingly, it is a primary object of the present invention to solve the aforenoted drawbacks and difficulties and to facilitate close, neat spacing in the placement of various indicia-bearing members on a hardware display panel.

Another object is to avoid the consumption of substantial amounts of time in setting up a complete hardware display. With respect to the time period involved, the system of the present invention is effective to reduce that period from two and one-half hours to about forty minutes.

SUMMARY OF THE INVENTION

A key feature of the present invention resides in the attainment of versatility and flexibility in the setting up of a hardware display system. Thus, in accordance with the present invention, one is permitted to up-date the display by shifting or changing the out-of-stock cards forming part of the display or even to shift or change trays or booklet-holding containers and the like as different combinations of hardware products are modified or changed.

The above-noted feature contrasts with methods that have sometimes been adopted to solve the aforenoted drawbacks, namely, expedients such as the use of pressure sensitive adhesive labels, or the use of silk screening or other techniques, to affix the required indicia on the panel. Such techniques are not regarded as useful solutions because in both cases, there is great difficulty in removing the indicia in the event that the particular hardware product in a given location is to be changed; that is, when another hardware item is to be substituted in that space where the indicia has already been affixed.

Briefly described, the present invention provides a display system and a technique associated with that system which makes for very fast setting up of a particular hardware display. This results from the provision of the present invention which comprises a carrier sheet adapted to be placed against a particular panel member. This carrier sheet constitutes an integrated arrangement of the indicia-bearing out-of-stock cards, for example, which are connected by a webbing. The indicia-bearing cards have slit-like perforations along their borders with the webbing and they carry apertures which are precisely located by prearrangement so that they will line up with predetermined corresponding apertures in the panel member. As a result, the hooks on which the hardware products are to be placed can be readily inserted through both sets of apertures, that is, through those formed in the cards and into those formed in an array on the panel. Once the carrier sheet has been placed against the panel member and has been properly indexed, that is, the edges of the carrier sheet have been set against the edges of the assigned panel member, and once the hooks have been inserted, then the webbing can be readily removed because of the slit-like perforations. Consequently, in very short order, each of the appropriate out-of-stock cards has been placed in the discrete location where it belongs, and the entire group of appropriate hooks can be inserted into the proper panel apertures. All that remains thereafter is to place or to hang the particular hardware products in accordance with the guidance furnished by the already mounted cards.

Other and further objects, advantages and features of the present invention will be understood by reference to the following specification in conjunction with the annexed drawing, wherein like parts have been given like numbers.

BRIEF DESCRIPTION OF THE DRAWING

FIG. 5 is a perspective view of the display apparatus, particularly illustrating the placement of a variety of hardware products for display purposes in the locations indicated by the respective indicia-bearing cards;

FIG. 6 is a horizontal sectional view, taken on the line 6—6 of FIG. 5, of a fragment of a display panel, illustrating several indicia-bearing cards and the hardware packages associated therewith;

FIG. 7 is a vertical sectional view, taken on the line 7—7 of FIG. 6, illustrating the details of the mounting of the hardware packages.

DESCRIPTION OF PREFERRED EMBODIMENT

Figure 1:
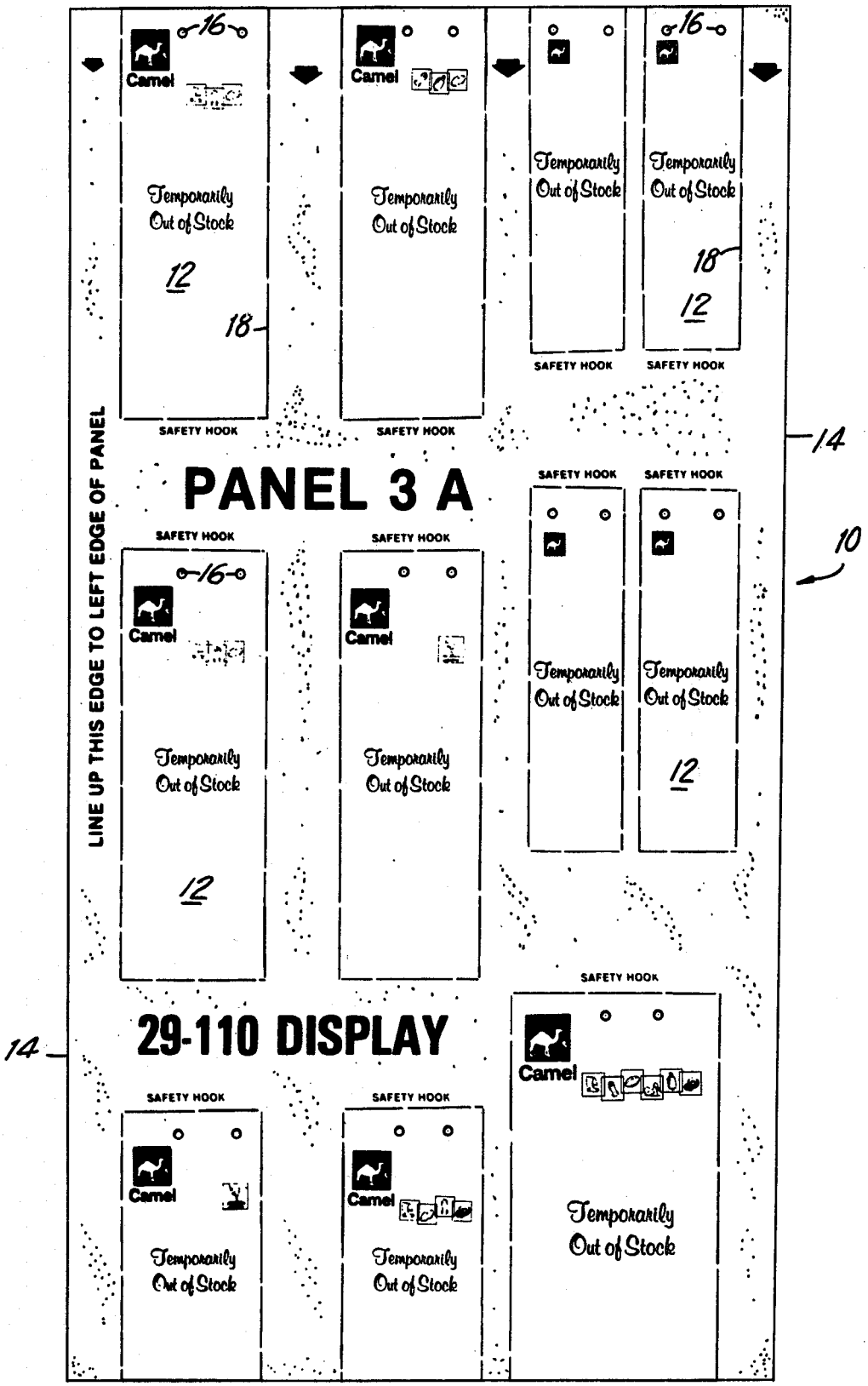
FIG. 1 is a plan view of a carrier sheet in accordance with a preferred embodiment of the present invention.

Referring now to the figures which illustrate the preferred embodiment of the hardware display system of the invention, it will be first noted that in FIG. 1 a carrier sheet 10 is illustrated. This carrier sheet, in accordance with a primary feature of the present invention, constitutes an integrated arrangement of indicia-bearing members or cards 12 which serve eventually to identify which particular hardware product is to be placed in a given location on the display apparatus. By the term "integrated arrangement" is meant the arrangement of the individual cards 12 in such spaced relationship as to indicate where particular hardware products are to be located, including the provision of a connecting webbing 14 which connects all of the cards in a particular array as illustrated in FIG. 1. Discrete pairs of apertures 16 are usually provided for each of cards 12, these apertures being so located that they match with corresponding pairs of apertures in display board panels. Slit-like perforations 18 extend completely around the periphery of each of the cards 12.

Figure 2:
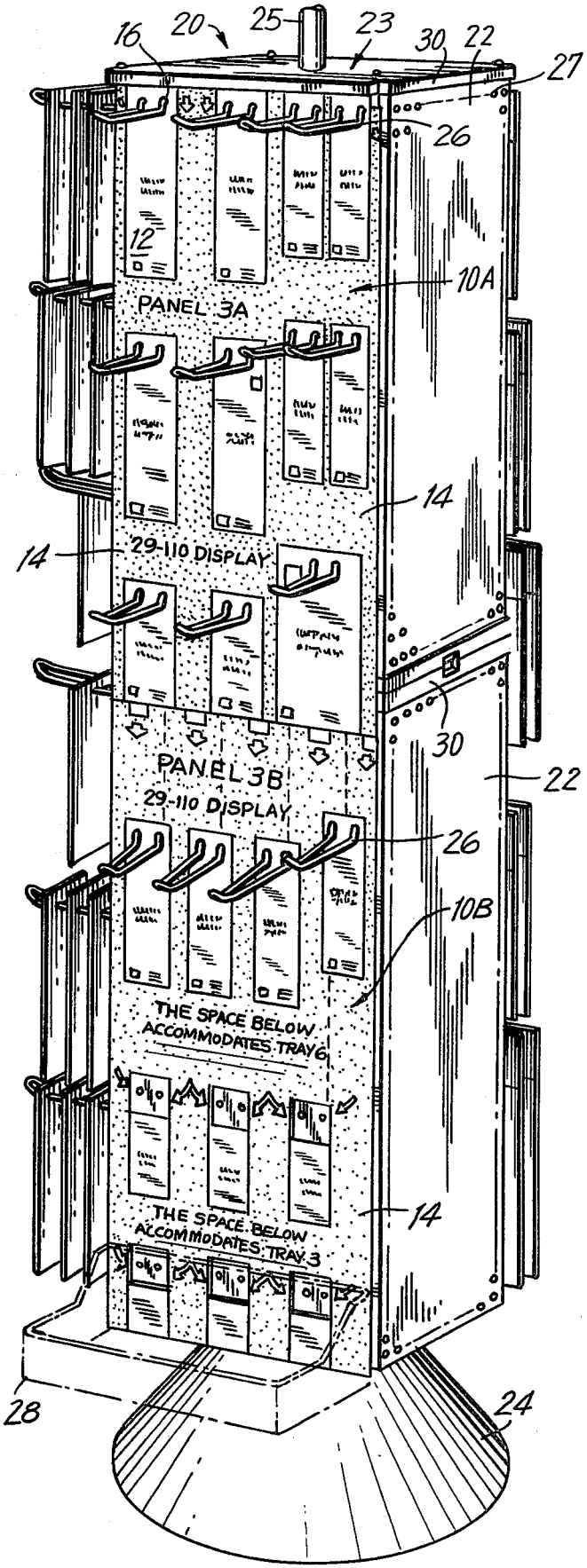
FIG. 2 is a perspective view of a floor merchandiser in the form of a three-dimensional display apparatus which incorporates carrier sheets like the one previously illustrated in FIG. 1.

Referring now to FIG. 2, a complete display apparatus 20 is therein illustrated, this display apparatus being a more or less conventional, three-dimensional rack or display system comprising pairs of panels or panel members 22 on each side of the four sides of a framework 23 which is carried on a supporting pedestal 24 and is rotatable on an upstanding shaft 25.

In particular it will be noted that the given carrier sheet 10 of FIG. 1 is again illustrated in FIG. 2, being therein identified as sheet 10A. Moreover, sheet 10A is shown as having been placed in abutting relationship with the upper panel member 22 which partly forms one side of the display apparatus 20. Of course, it will be appreciated that rather than two panel members per side, a single panel member 22 co-extensive with that side, or a greater number of members, could be provided. In setting up the hardware display, the carrier sheet 10A is placed against upper panel member 22 with the edges of each appropriately aligned. Then several hooks designated 26 are inserted through respective pairs of apertures 27 which are provided in an orderly spaced array in panel members 22.

The particular hooks 26 illustrated in FIG. 2 are termed safety or butterfly hooks, which are provided with double prongs. These are often employed in connection with conventional hardware display apparatus. However, the system of the present invention envisions that a variety of other types or kinds of hooks, such as straight hooks and the like, can be employed in the event that somewhat different hardware items from those specifically illustated are to be displayed.

Accordingly, although the particular carrier sheet 10A shown mounted to the upper panel in FIG. 2 is constituted essentially of a plurality of indicia-bearing cards 12 and interconnecting webbing 14, it will be understood that it is also a common arrangement in well-known hardware displays to devote specific spaces for trays designed to hold bottles or cans of liquids or the like. Such trays are fashioned with integral hooks that can be inserted at appropriate blank spaces formed in the carrier sheet and thence can be inserted into apertures in panel members 22. Thus, the present invention contemplates that other similar carrier sheets, such as the sheet 10B, shown in indexed relationship with one of the lower panel members 22 in FIG. 2, would have such a format, whereby trays, such as tray 28 seen in phantom outline, would be readily mounted. In addition to trays, brochure containers or holders can be accomodated by providing other blank spaces in a carrier sheet indicating positioning of holders along dotted lines at which the pressure sensative backing on such holders can be affixed into the display panel.

It will be appreciated that all the panel members 22 are simply fitted together on the framework 23 of the display rack by appropriate horizontal retainer strips 30. These panel members are typically constituted of pressed wood, although it is also common to manufacture them from plastic material.

Figure 3:
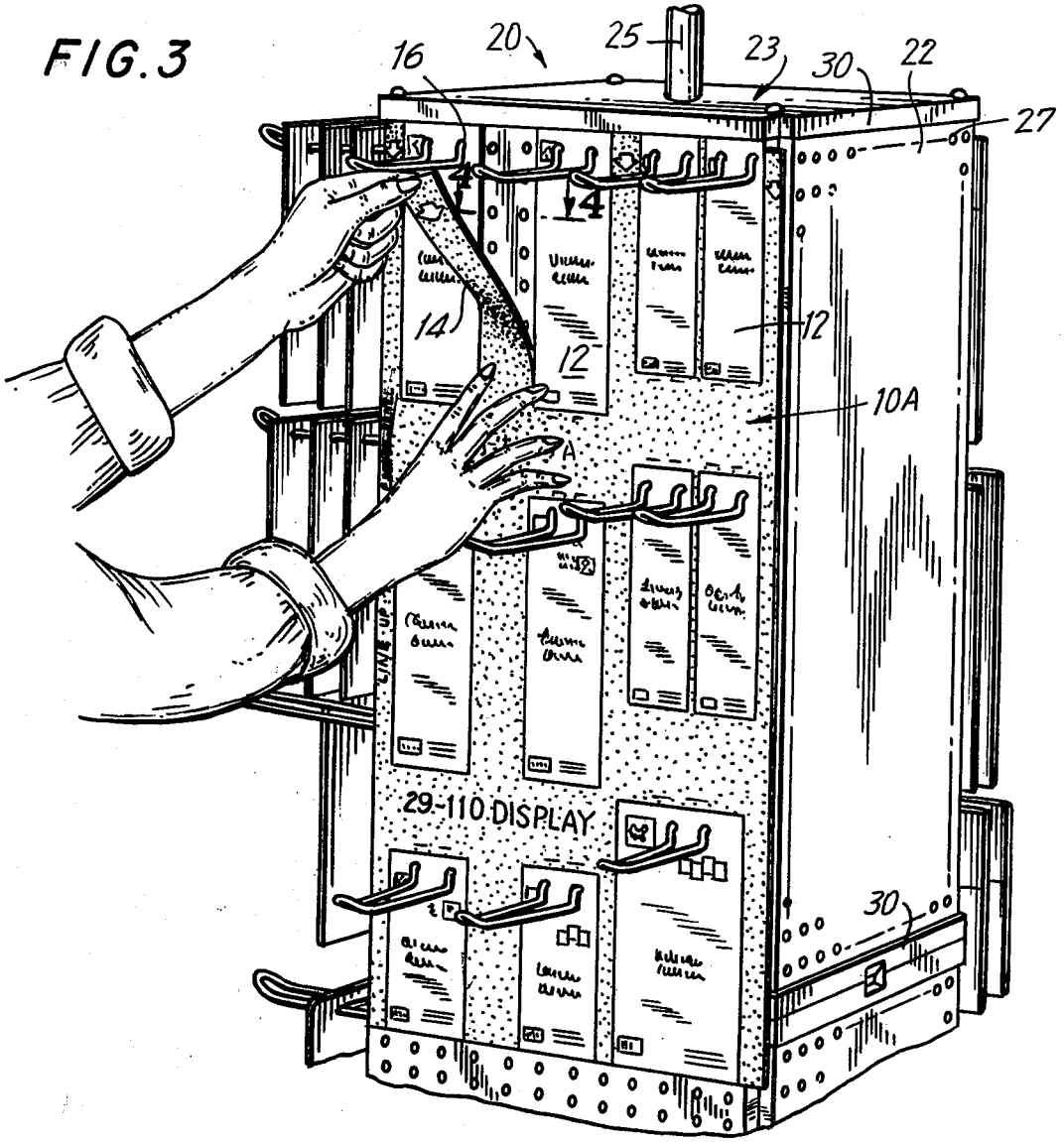
FIG. 3 is another perspective fragmentary view of the display apparatus of FIG. 2, and particularly illustrating the removal of the webbing which is normally connected between the indicia-bearing cards, but which is capable of being readily removed.
Figure 4:
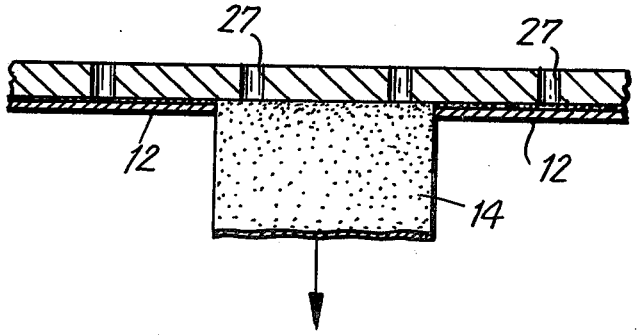
FIG. 4 is a horizontal sectional view, taken on the line 4—4 of FIG. 3, illustrating indicia-bearing cards in abutting relationship with the display panels.

Referring now to FIG. 3, it will be understood that when any of the carrier sheets, such as 10A, has been mounted on a panel and the necessary hooks for each have been inserted, the webbing 14 is readily removed by simply tearing along the slitted perforation lines (FIG. 1) formed at the periphery of the cards 12. In FIG. 3 this process of removing the webbing is illustrated as just having begun. Eventually, as seen in FIG. 5, all of the webbing has been removed and a number of hardware items in packages 32 are seen as having been mounted on the hooks 26. These hooks are securely held in the panel members 22 by reason of the several successive right-angle bends 34 formed in the hooks.

Similar mounting of other hardware items is effectuated on each of the other panel members forming the other sides of the display apparatus. As indicated previously with reference to the lower panel member 10B in FIG. 2, a variety of bottles and cans are to be placed in tray 28 which is mounted at the bottom of that panel member.

What has been disclosed is a unique method and system for displaying hardware products so as to make extremely efficient the disposition of the products in appropriate places on display panels, and particularly to cut down the time normally consumed in setting up a point of sale hardware display. In accordance with the system, indicia-bearing, out-of-stock, cards which guide the placement of the hardware products in setting up the entire display can be quickly deployed in their proper locations by reason of the simple removal of a webbing which interconnects with discrete areas at which the cards are located on a carrier sheet.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. A system for displaying hardware items or products, comprising:

a panel member having a number of apertures provided in an orderly matrix or array;

a carrier sheet constituting an integrated arrangement of discrete indicia-bearing members each of which identifies a particular hardware product, connected by a webbing, said indicia-bearing members having perforations along their borders with the webbing and carrying first apertures which are located so that they line up with predetermined corresponding second apertures in said panel number when the carrier sheet is brought into closely spaced relationship with the panel member, whereby hooks can be readily inserted successively through said first and second apertures and the webbing can be removed.

2. A system as defined in claim 1, in which said panel member or members are constituted of pressed wood or plastic.

3. A system as defined in claim 1, in which said carrier sheet is constituted of heavy paper and said perforations are defined by a series of slits.

4. A system as defined in claim 1, in which said indicia-bearing members are cards which remain in predetermined spaced locations when the webbing has been removed.

5. A system as defined in claim 1, in which said indicia-bearing members carry a pair of first apertures for receiving hooks having double prongs.

6. A method for displaying hardware items or products, comprising the steps of providing a panel member having a number of apertures provided in an orderly matrix;

placing a carrier sheet of a size which is substantially the same as a panel member in abutting indexed relationship with said panel member; said carrier sheet constituting an integrated arrangement of indicia-bearing members identifying the hardware products to be displayed, said members being interconnected by a webbing having perforations along their borders with the webbing, and carrying apertures which are located so that they line up with predetermined corresponding apertures in said panel member;

tearing away the webbing along the perforations so that only the indicia-bearing members remain in appropriate locations spaced from each other and each in near adjacency to said panel member.

* * * * *